US006702010B2

(12) United States Patent
Yuratich et al.

(10) Patent No.: US 6,702,010 B2
(45) Date of Patent: Mar. 9, 2004

(54) APPARATUS AND METHOD FOR ACTUATING ARMS

(75) Inventors: Michael Andrew Yuratich, Hamble (GB); Frank Baxter Bardsley, Andover (GB)

(73) Assignee: Computalog USA, Inc., Fort Worth, TX (US)

( * ) Notice: Subject to any disclaimer, the term of this patent is extended or adjusted under 35 U.S.C. 154(b) by 0 days.

(21) Appl. No.: 10/032,644

(22) Filed: Dec. 28, 2001

(65) Prior Publication Data

US 2002/0108487 A1 Aug. 15, 2002

(51) Int. Cl.[7] ..... E21B 23/14

(52) U.S. Cl. ..... 166/66; 166/241.5; 181/105; 250/268; 367/35; 324/367

(58) Field of Search ..... 166/66, 206, 241.1, 166/241.5; 175/4.51; 367/35, 911; 181/102, 105; 250/268; 324/333, 338, 351, 367, 374, 347

(56) References Cited

U.S. PATENT DOCUMENTS

| | | | |
|---|---|---|---|
| 3,423,671 A | | 1/1969 | Vezin |
| 3,750,214 A | * | 8/1973 | Caliendo et al. |
| 3,977,468 A | | 8/1976 | Brewer et al. |
| 4,056,004 A | | 11/1977 | Roesner |
| 4,251,773 A | | 2/1981 | Cailliau et al. |
| 4,422,043 A | | 12/1983 | Meador |
| 4,432,143 A | | 2/1984 | Moriarty et al. |
| 4,517,835 A | | 5/1985 | Kerzner |
| 4,594,552 A | | 6/1986 | Grimaldi et al. |
| 4,614,250 A | * | 9/1986 | Panetta et al. |
| 4,692,707 A | | 9/1987 | Locke et al. |
| 4,715,440 A | | 12/1987 | Boxell et al. |
| 4,862,090 A | * | 8/1989 | Vannier et al. |
| 5,101,104 A | | 3/1992 | Schroeder |
| 5,355,950 A | | 10/1994 | Zwart |

OTHER PUBLICATIONS

The Six–Arm Dipmeter, A New Concept by Geosource; by Rodney Morrison & James Thibodaux; presented at SPWLA 25th Annual Logging Symposium, Jun. 1984.

* cited by examiner

*Primary Examiner*—Roger Schoeppel
(74) *Attorney, Agent, or Firm*—Geoffrey A. Mantooth; L. Bruce Terry

(57) ABSTRACT

In an apparatus and method for actuating arms used on a borehole data-logging tool to deploy measuring instruments against a borehole wall, a mandrel is provided. At least one arm carried by the mandrel is mounted to the mandrel to move between an expanded position, in which a part of the arm projects from the mandrel, and a retracted position. A resilient biassing compression spring provides a resilient biassing force on each arm for biassing the arm towards its expanded position. A hydraulic piston and cylinder assembly associated with each arm restrains the arm against movement towards its expanded position. A drive piston and cylinder assembly acts upon the resilient biassing compression springs for adjusting the resilient biassing force acting upon each arm.

13 Claims, 3 Drawing Sheets

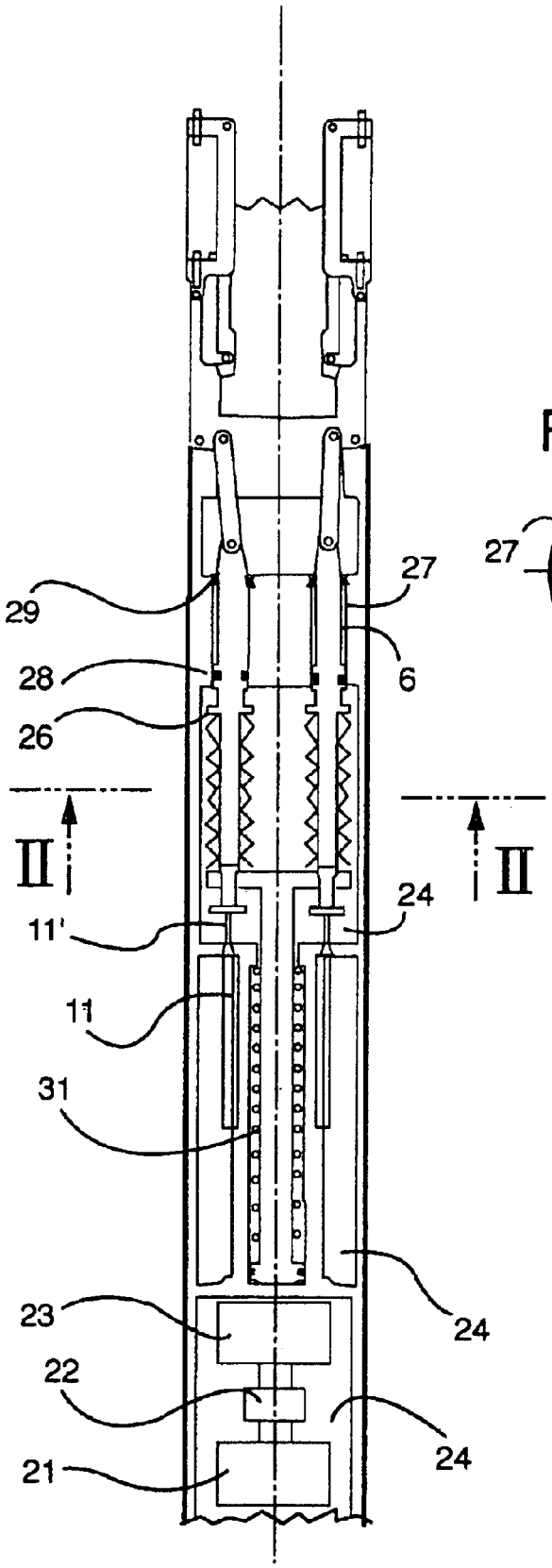
FIG. 4
FIG. 2
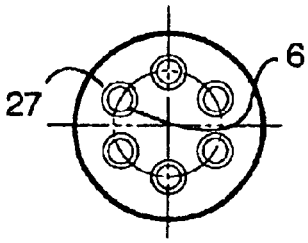
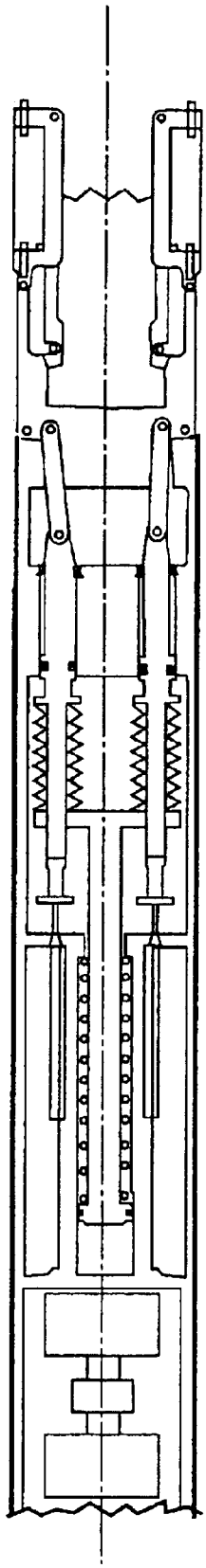
FIG. 5

APPARATUS AND METHOD FOR ACTUATING ARMS

FIELD OF THE INVENTION

This invention relates to an apparatus and method for actuating arms, and in particular to an apparatus and method for the controlled actuation of a plurality of arms as may be used on a borehole data-logging tool such as a measuring sonde, and be used to deploy measuring instruments against a borehole wall.

1. Background of the Invention

Boreholes are drilled into the earth for the extraction of oil or gas, for example, or for the analysis of rock to determine whether oil or gas might be present. Following drilling of the borehole, a data-logging tool may be introduced into the borehole to provide data upon the borehole and the surrounding rock.

A very basic use of a data-logging tool is to determine the borehole transverse dimensions by measuring the cross-sectional dimensions of the borehole at chosen positions within the borehole. A more sophisticated data-logging application is the taking of measurements within the borehole which can indicate the location and direction of rock strata, for example.

2. Description of the Prior Art

A typical borehole data-logging tool comprises a cylindrical mandrel carrying one or more arms, these arms being mounted to pivot relative to the mandrel. By various means the arms are kept substantially parallel to and within the circumference of the mandrel while the tool is conveyed to the zone of interest in the borehole. When measurements are required the arms are rotated on their pivots so as to swing their distal ends outwards until they make contact with the borehole wall.

In basic data-logging applications the cross-sectional dimensions of the borehole can be determined from the distances to the contact points from the mandrel. By analogy with traditional hand tools used to determine the distance between two points, the arms used in this way are referred to as calipers. These distances typically are calculated from measurements of the internal movement of the opening mechanism and knowledge of the geometry of the mechanism and the arm lengths.

In elementary caliper tools, an opposed pair of arms are coupled together so as to open symmetrically about the mandrel, so that the mandrel must be centered within the borehole for both of the opposed pair of arms to contact the wall. A second pair of such arms may be arranged rotationally about the longitudinal axis of the mandrel a quarter-turn from the first pair, to give a second cross-sectional dimension. If the borehole is elliptical in cross-section then typically the tool will rotate into alignment such that the two cross-sectional dimensions are measured along the principal axes of the ellipse. However, the borehole will often be other than substantially vertical, and the weight of the tool will typically cause the mandrel to lie closer to the lower side of the borehole. Because the arms are linked in opposed pairs, the uppermost arm of at least one of the pairs may not make contact with the borehole wall.

Even if the borehole is circular. so that the cross-sectional dimensions are diameters of the borehole, unless the borehole is substantially vertical a proportion of the weight of the tool will be borne by the lowermost arm (or arms), and it is necessary for that arm (or those arms) to force the tool into a central position within the borehole so that the opposed arm(s) can contact the borehole wall.

In a more advanced tool as disclosed in U.S. Pat. No. 4,715,440, the arms are independently pivoted so that borehole irregularities can be determined and so that centralisation of the mandrel is not required. This tool uses a motorised screw mechanism in which an internal plate is translated longitudinally by rotation of the screw. The plate presses against a set of springs for each of the arms, the springs in turn causing movement of a link which can pivot a respective arm open or closed. The provision of the springs between the plate and each link allows the arms to attain independent pivoted positions relative to the mandrel.

A major disadvantage of this tool is that the speed of opening is substantially constant, so that although fine adjustment of contact force can be obtained, the time taken to move the arms from closed to open is slow, reducing the suitability of this tool to take measurements close to the bottom of the borehole.

Measuring to the bottom of a borehole is often important to maximise the knowledge obtained, and on occasion to determine if additional drilling is required. However, the fluid in the bottom of the borehole will often have been left stagnant for many days prior to measurements being made. Besides debris which might be present at the bottom of the hole, mud particles, which are deliberately introduced into the borehole so as to increase the fluid density and to prevent the borehole collapsing, will often have sunk to the bottom of the borehole during this period, rendering the fluid there relatively heavy and tenacious. It is well-known that the presence of such mud results in a high risk of the tool becoming stuck if it is allowed to dwell therein. When the tool reaches close to the bottom of the borehole, it is therefore desirable to be able to open the arms rapidly so as to be able to commence data-logging and allow subsequent retrieval of the tool within a few seconds. Such rapid opening is not possible with the tool or method disclosed in U.S. Pat. No. 4,715,440.

A known means of accomplishing rapid opening is to introduce the tool into the borehole with energy stored in a compressed spring, and to provide a means to release the spring so as to activate the arm opening mechanism with high force, and rapid opening, once the tool is in its chosen position. One means by which this may be achieved is disclosed in U.S. Pat. No. 4,594,552 which includes a single arm biased outwardly by a leaf spring. A major disadvantage of this tool is that only one arm is provided.

U.S. Pat. No. 4,056,004 discloses a tool having four arms, each of which can carry a sensor pad or other component which is desired to be moved into contact with the borehole wall. Each arm has its own spring and is biased outwardly independently of the other arms. In one embodiment each arm comprises a respective bow spring attached at each of its ends to the body of the tool; in another embodiment each arm comprises linkages which are also connected at each end to the tool, with a spring acting upon one end of the linkage to bias the center of the linkage outwardly. A restraining means is provided to hold the arms in their retracted positions, the restraining means comprising a longitudinally movable member which can act upon one of the ends of the bow springs (or linkages) to increase the distance between the ends thereof and so force the bow springs (or linkages) to lie substantially along the longitudinal axis of the tool. The restraining means described is solenoid actuated, but is indicated alternatively to be hydraulically or pneumatically actuated.

A major disadvantage of the disclosures of U.S. Pat. Nos. 4,594,552 and 4,056,004 is that there is no means to regulate the contact force between the sensor pads and the borehole wall, and the contact force will vary with the borehole size, i.e. the force imparted by the arms upon the borehole wall is dependent upon the distance by which the arm must be opened to engage the borehole wall. Also, if U.S. Pat. No. 4,056,004 is being used in an a circular borehole such as that shown in the drawings, the contact force for one of the arms may differ significantly from the contact force of another of the arms. Another major disadvantage is that the spring force is constantly acting, and any failure of the restraining means or in its control circuitry will cause the arms to move outwardly, perhaps preventing removal of the tool from the borehole.

SUMMARY OF THE INVENTION

The aim of the present invention is to reduce or avoid the disadvantages of the prior art arrangements described above.

The invention provides an apparatus for actuating arms comprising a mandrel, and at least one arm carried by the mandrel, the one more arms being mounted to the mandrel to pivot between an expanded position, in which a part of the arm projects from the mandrel, and a retracted position. The one or more arms have a resilient biasing means. A drive means is provided, adapted to load the resilient biasing means of all of the pusher means. A restraining means, comprising a hydraulic piston and cylinder assembly, is associated with each arm, a separate restraining means being provided for each of the arms, and it is arranged that release of the restraining means permits the arms to move in response to a force provided by the resilient biasing means.

The drive means can also be a hydraulic piston and cylinder assembly. Actuation of the drive means whilst the arms are in contact with the wall of the borehole can be used to increase or decrease the contact force. Thus, it will be understood that when the apparatus is in use, with all of the arms in contact with the borehole wall, each of the resilient biasing means is imparting a contact force to the arm. Actuation of the drive means can further load the resilient biasing means to increase the contact force, or can partially release the resilient biasing means to reduce the contact force. The drive means can also release the resilient biasing means, reducing the force biasing the arms outwardly (perhaps to zero), ensuring that the arms can be retracted and the tool removed from the borehole, even in the event of a failure of the restraining means.

Accordingly, it will be understood that for more sophisticated data-logging applications, the borehole wall-engaging contacts are required to carry sensors, for example sensors responsive to electrical resistance. With such applications, the arms are typically expanded so that the sensors engage the borehole wall adjacent the distal end of the zone of interest within the borehole (which might be the bottom of the borehole, for example), and the tool is withdrawn from the borehole with the sensors remaining in contact with the wall, continuous or discrete measurements being taken as the tool is withdrawn. The tool is typically withdrawn from the borehole by a cable connected to a winch above ground. A smooth tool motion is desirable so that measurements can be taken at all required positions within the zone of interest, i.e. it is desired to avoid the tool becoming stuck. If the tool becomes stuck, even momentarily, the cable will extend resiliently until the tension therein overcomes the friction restraining the tool, whereupon the tool will move rapidly, removing some or all of the extension from the cable. During this rapid movement rock strata might be passed without suitable measurement. It is known to fit the tool with accelerometers so that the evidence of sticking can be obtained, but this does not allow the missed or unsuitable measurements to be recovered. To enable the tool to move smoothly along the borehole with the sensors in contact with the wall thereof, adjustment of the contact pressure is desirable, and the drive means described can provide this. The apparatus can therefore allow optimum contact to provide suitable data-logging whilst reducing friction and component wear.

For more sophisticated applications, the arm or arms can (each) carry a sensor pad, in which case means may be provided to allow the one or more sensor pads to maintain its orientation relative to the mandrel.

The invention also provides a method of actuating the arms of a data logging tool in which the arms are retracted and restrained in their retracted position during introduction of the tool into a borehole. The drive means is actuated to load the resilient biasing means, and when the tool is in its desired position, the restraining means is released to allow the resilient biasing means to urge the arms against the wall of the borehole.

BRIEF DESCRIPTION OF THE DRAWINGS

The invention will be described, by way of example, with reference to the following description of an embodiment of the invention as shown in the accompanying schematic drawings, in which:

FIG. 2 shows a transverse view through the apparatus of FIG. 1;

FIG. 4 shows a side-sectional view of the apparatus of FIG. 1, with arms closed; and FIG. 5 shows a side-sectional view of the apparatus of FIG. 1, with arms closed and energised.

DESCRIPTION OF THE PREFERRED EMBODIMENTS

Figure 1:
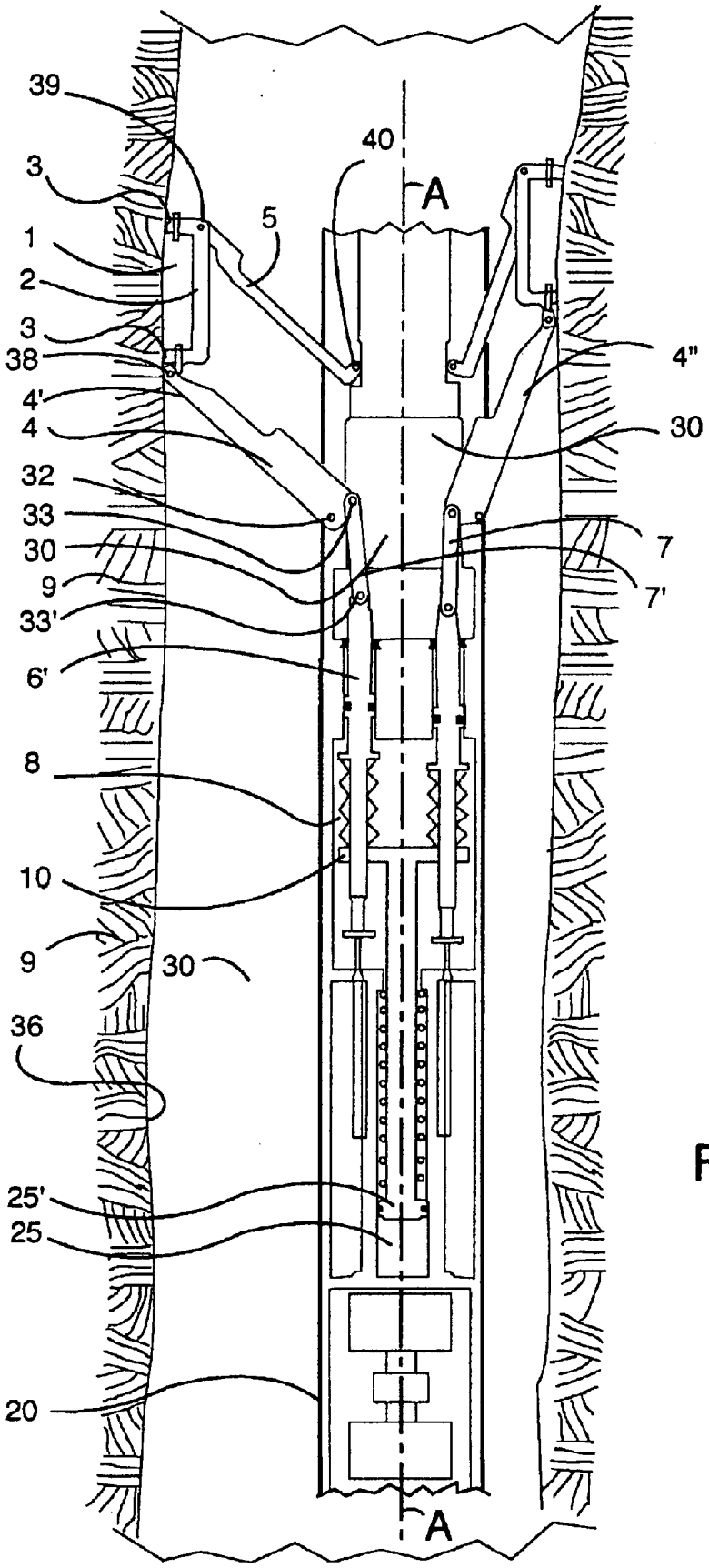
FIG. 1 shows an embodiment of the apparatus of the invention in side-sectional view within a borehole, the embodiment comprising a six-arm measuring tool, with arms open.
Figure 3:
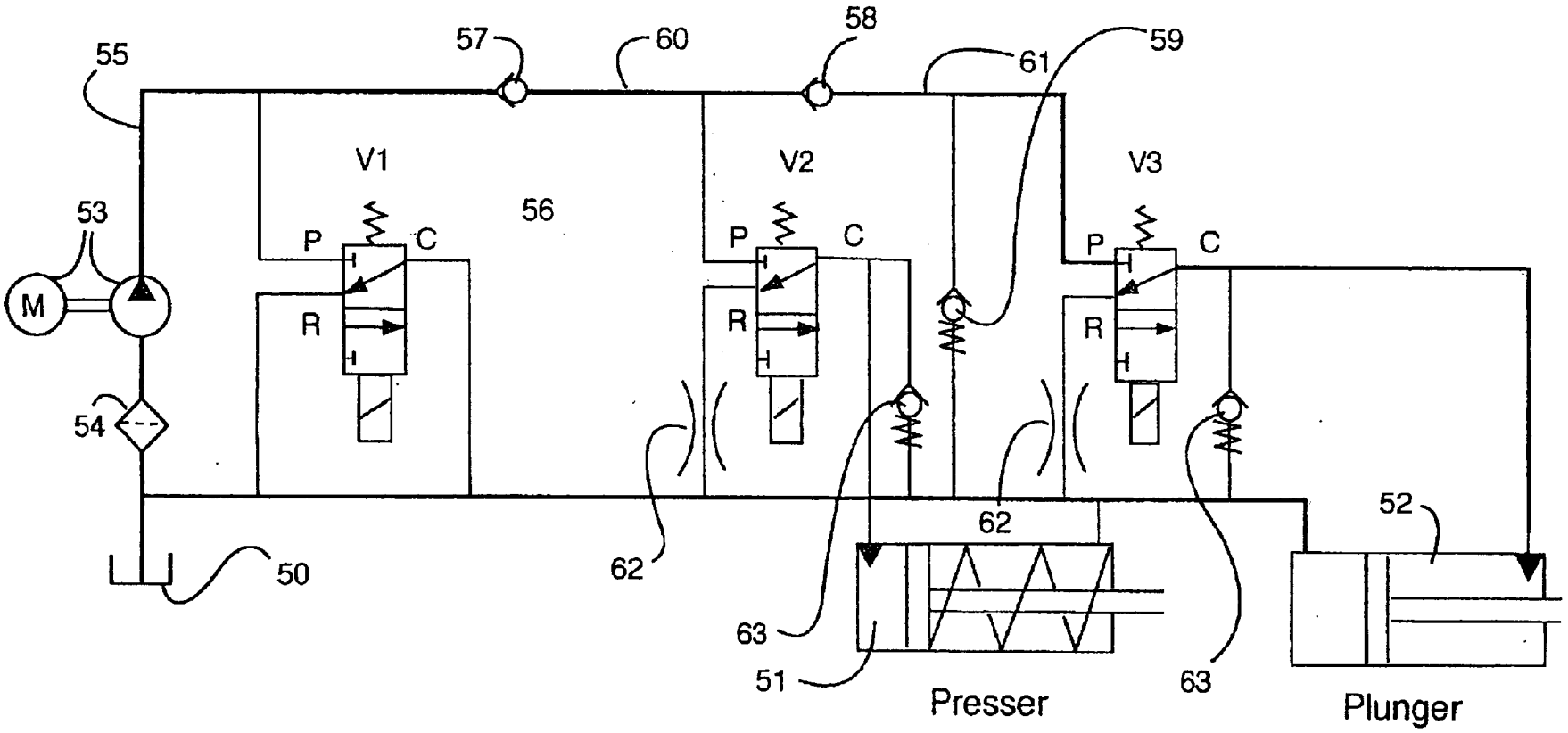
FIG. 3 shows a hydraulic circuit for use with the apparatus of FIG. 1.

Referring to FIGS. 1, 2 and 3, an embodiment of a data-logging tool according to the present invention is shown, which comprises a cylindrical mandrel (20) which houses a hydraulic pump (21), a filter (22), a control-valve block (23), a hydraulic drive or presser cylinder (25), presser rod (25'), six pushers or plungers (6) and annular hydraulic plunger cylinders (27). The mandrel internal interstices (24) are filled with hydraulic oil which is substantially at the same pressure as that of the borehole fluid (30) surrounding the tool. This so-called tank oil will be considered herein as zero pressure relative to the hydraulic working pressure of the tool. Tank oil is raised to working pressure by pump (21), which may be of any suitable type, for example the type commonly known as a piston pump, and available commercially. Oil flow from the pump is controlled by the valve block (23) by a means disclosed below, and routed variously back to tank, to cylinder (25) or to cylinders (27).

The cylinders (27) each comprise a through-bore within the body of the mandrel which is closed at one end by a seal (29) mounted therein. Each cylinder contains a piston provided by an O-ring or other sliding seal set in a ridge (28) mounted on the plunger (6).

The section shown in FIG. 2 illustrates how six plungers may be fitted into the mandrel, rotationally distributed about the mandrel center line. It will be understood that in other embodiments of the invention more or fewer than six arms (and plungers) may be used, and that the distribution of the arms and plungers need not be uniform. The side view in FIG. 1 is conveniently chosen to show a pair of diametrically opposed plungers.

Plunger motion back and forth along the axis of the mandrel is used to actuate the arms (4). The illustrated arm (4') is shown fully open and the illustrated arm (4") partially open, both in contact with the borehole wall (36), the mandrel being shown off-centre within the borehole. Arm (4') is pivoted in the mandrel by pin (32). Link (7') is pinned to arm (4') and plunger (6') at (33) and (33'). A crank is formed by the distance between pin (32) and pin (33), so that as plunger (6') moves, the line (32) to (33) must turn about pin (32). Since these pins are set in the mass of the entire arm (4'), the arm must open or close with plunger motion. The other arms are similarly configured.

The linkage so far described is sufficient for the actuation of a caliper tool where the arm tips come into contact with the borehole wall and may be suitable in some applications. The embodiment of FIG. 1 is, however, suited to more sophisticated measuring applications, and includes measuring pads (1) carried in pad links (2). Each pad link (2) is supported by arm (4) pinned at (38), and by one end of trailing link (5) pinned at (39). The other end of the trailing link (5) is pivoted to the mandrel (20) at (40). The pins at (32), (38), (39) and (40) are positioned at the vertices of a parallelogram, so that the lines (32) to (40) and (38) to (39) remain parallel for any opening angle of the arm (4). The pad links (2) are constructed to hold the pads (1) at a fixed angle to said lines such that the pad contact with the borehole wall (36) can be maintained parallel to the longitudinal axis (A—A) of the mandrel (20) for any arm opening, as shown for the differing representative openings of arms (4') and (4") in FIG. 1.

The pads (1) in this embodiment are fitted into the pad links (2) using axial pins (3), such pins allowing pad articulation about an axis parallel with the longitudinal axis (A—A) of the mandrel, and hence allowing improved pad contact when the mandrel is not centered in the borehole.

Each plunger (6) carries a resilient biasing means, which in this embodiment is a mechanical compression spring (8), which abuts ridge (26) of the plunger. The spring (8) also abuts the presser plate (10). The springs (8) may be coil springs but are preferably a stack of disk springs (sometimes called Belleville springs or washers) since these enable a very strong spring to be achieved in a relatively small volume.

When the presser plate (10) moves to the right as drawn in FIGS. 1, 4 and 5, it will urge each plunger (6) to the right by way of the springs (8), and hence urge the arms to open and the pads to move into contact with the borehole wall (36). Typically, one pad (1) will make contact first. As the presser plate (10) continues to move, the spring (8) carried by the plunger (6) for the first pad will begin to compress. As successive pads (1) make contact, their associated springs start to compress. FIG. 1 shows two pads (1) in contact with the borehole wall (36) at differing arm opening angles, and hence differing spring compressions. The apparatus therefore provides a means of maintaining independent pad contact. By making the unloaded spring lengths long compared to their compression at maximum contact force, the contact forces for all of the pads (1) can be similar even for widely differing arm expansions such as typically found when the tool is off-centred by its own weight in horizontal boreholes.

The expansion of each arm (4) may be determined by measuring the position of its plunger (6) and knowledge of the geometrical relationship between arm opening and plunger position. Suitable position transducers (11) may be mounted to the mandrel (20) and connected to the plungers (6) by rods (11'). The transducers (11) are preferably linear variable differential transducers, although less preferably linear potentiometers may be used.

The foregoing describes the mechanical action of a representative linkage for opening the arms (4) with variable contact force and independent amounts of expansion. It does not explain how the arms may be closed or how they may be opened especially rapidly. A suitable hydraulic circuit will now be described with reference to FIG. 3. For clarity the drillings, pipes and o-ring seals needed to route pressurized oil to the various parts of the tool are not shown in the schematic drawings of the apparatus. It will be appreciated by those familiar with the hydraulics engineering art that these may be engineered following known practices, and it suffices to state herein that the valve block is ported to the plunger cylinders, presser cylinder and tank identified above.

In FIG. 3, tank (24) is represented by numeral (50), motor-pump (21) by numeral (53), and filter (22) by numeral (54). Presser cylinder (25) is represented by numeral (51) and the plunger cylinders (27), connected together, by numeral (52). Remaining parts in FIG. 3 are contained within the valve block (23).

Three individually operated solenoid valves, V1, V2, V3, conveniently of the same type, are employed. The conventional symbols for these show them in their unpowered state, in which the pressure port P is blocked, and control port C is connected to return port R. When energised, return port R is blocked and pressure port P is connected to control port C.

Valve V1 performs the function of reducing the pump load when the pump starts, which is advantageous for certain types of motor-driven pumps, such as induction motor-driven pumps. When V1 is powered, any oil discharging from the pump into pressure line (55) will circulate through path (56) and P-C and back to tank, so there is negligible pressure build-up. When the pump is running at operating speed, the valve may be de-energised. This circuit is unnecessary for pump motors with high starting torque such as brush or brushless dc motors.

When the pump is running and all valves are de-energised, then oil will flow through first (57) and second (58) check valves (non-return valves) and through pressure relief valve (59) back to tank. Thus pressure lines (55), (60) and (61) build up to system back pressure set by the relief valve (59), which may typically be 2,500 psi. Pump flow rate may be a few cc/second for sufficiently speedy operation of the tool. These figures are representative and may be varied for particular applications without affecting the principle of the tool.

Valve V2 controls the supply of oil to the presser plate cylinder (25,51) and valve V3 controls the supply of oil to the six plunger cylinders (27,52). Oil is supplied to the cylinders at system pressure by way of these valves' P-C ports when the respective valves are energised. Oil in a cylinder is free to discharge by way of the C-R port to tank when the corresponding valve is de-energised.

Restrictor valves (62) are not essential to the operation of the circuit but provide a means of slowing the cylinder discharge rate if required. Thermal relief valves (63) are set to open at a safe pressure somewhat higher than the system pressure, such as 4,000 psi. They provide a means of relieving the pressure built up in trapped volumes of oil as it heats up in operation, and are desirable to prevent mechanical damage. In typical service they will not operate and can be ignored for further descriptive purposes. The interconnection of the components of the circuit within valve block (23) by means of borings, blocking plugs and hydraulic couplings is achievable by means commonly known in the hydraulics art.

The foregoing description of the components is sufficient background for an explanation of the operation of the representative embodiment of the invention, which operation will now be described.

Prior to the tool being introduced into the borehole, V3 is energised and the pump is run. Oil entering the plunger cylinders fills them, moving the plungers back until the tool is in a tightly closed position, as shown in FIG. 4. The pump may then be stopped, if desired, to reduce wear on the components. Oil cannot escape the plunger cylinders (27, 52), except by minor leakage or thermal relief, as it is blocked by check valve (58).

As the tool approaches the distal end of the zone of interest, which may for example be the bottom of the borehole, the pump is run again and valve V2 is energised to supply oil to the presser plate piston (25,51). This causes the presser plate (10) to move forward and compress (preferably fully) the springs (8). Spring (31) also partially compresses. Any leakage in the plunger circuit is made up by flow through check valve (58). The pump is then stopped. Oil cannot flow out of the presser cylinder (25,51) as it is blocked on the one hand by check valve (57) and on the other by the completely filled plunger circuit. The tool is now as shown in FIG. 5, i.e. ready to open.

To open the tool, valve V3 is de-energised, allowing the oil in the plunger cylinders (27,52) to dump to tank. Energy stored in springs (8) will be released as they extend, pushing the plungers forward and rapidly opening the arms (4). This is the "fast opening" feature of the invention.

The contact force of the pad (21) against the borehole wall (36) depends on the residual compression in springs (8). According to a "variable force" feature of the invention, this contact force may be increased by running the pump for short periods so that oil flows into the presser cylinder (25,51) by way of valve V2, increasing the compression in springs (8). Conversely, contact force may be decreased if valve V2 is de-energised for a short period, allowing presser cylinder oil to discharge to tank, as the presser rod (25') is urged back by the expansion of springs (8) and to a lesser extent spring (31). If neither the pump is run nor valve V2 is de-energised, then the pad load will remain substantially constant, varying slightly with oil leakage and borehole size variations.

The tool is closed after the data-logging run by de-energising valve V2, energising valve V3 and running the pump to push the plungers (6) fully back. The pump is stopped when the arms (4) are fully closed, leaving the apparatus in the same condition as for introduction into the borehole as described above.

If the power supply to the apparatus should fail for any reason, it will not be possible to run the pump motor and all of the solenoid valves will be de-energised. In this case, pressure in the plunger cylinders and presser plate cylinder will be free to discharge to tank. Spring (31) will push the presser plate back to its closed position. The arms (4) and links (5) will be free to be pushed in by knocking contact with the borehole wall as the tool is pulled up the borehole, residual seal friction on the plungers preventing any tendency to re-open. This is the "failsafe" feature of the invention.

The foregoing cycle of operation may be repeated as often as desired, without need to remove the apparatus from the borehole.

It will be apparent that some of the described components can be replaced by other suitable components without detriment to the performance of the invention. In one alternative embodiment, for example, the hydraulic actuation of the presser plate (10) can be replaced by a motor directly driving the presser plate; this might not always be preferable since it would require two motors, one to charge the cylinders 27, and one to drive the presser plate, but it might be desirable in some applications.

What is claimed is:

1. An apparatus for actuating arms comprising:

a mandrel;

at least one arm carried by the mandrel, the at least one arm being mounted to the mandrel to move between an expanded position, in which a part of the arm projects from the mandrel, and a retracted position;

resilient biassing means associated with the at least one arm for biassing the arm towards its expanded position;

restraining means associated with the at least one arm for restraining the arm against movement towards its expanded position, the restraining means being independent of the mandrel; and drive means acting upon the resilient biassing means for adjusting a resilient biassing force acting upon the at least one arm, the drive means being separate from the restraining means.

2. The apparatus according to claim 1 wherein the drive means can adjust the resilient biassing force acting upon the at least one arm between zero and a predetermined maximum force.

3. The apparatus according to claim 1 wherein the restraining means comprises respective hydraulic piston and cylinder arrangements, and wherein the drive means is also a hydraulic piston and cylinder arrangement.

4. The apparatus according to claim 3 wherein the at least one arm is connected to a respective pusher, the pusher having an enlarged portion comprising the piston of the piston and cylinder arrangement.

5. The apparatus according to claim 1 wherein each resilient biassing means is a first resilient biassing means, and wherein a second resilient biassing means is provided to bias the drive means in a direction to reduce the resilient biassing force acting upon the at least one arm.

6. The apparatus according to claim 3 having a hydraulic circuit comprising:

a reservoir of hydraulic fluid;

a pump to pressurise hydraulic fluid; and a first valve having a first position in which pressurised hydraulic fluid is routed from the pump to the cylinder of each restraining means, and a second position in which hydraulic fluid is routed from the cylinder of each restraining means to the reservoir.

7. The apparatus according to claim 6 wherein the hydraulic circuit also has a second valve having a first position in which pressurised hydraulic fluid is routed from the pump to the cylinder of the drive means, and a second position in which hydraulic fluid is routed from the cylinder of the drive means to the reservoir.

8. The apparatus according to claim 7 wherein the hydraulic circuit also has a third valve having a first position in which pressurised hydraulic fluid is routed to the reservoir, and a second position in which pressurised hydraulic fluid is routed to the first and second valves.

9. The apparatus according to claim 1 wherein the at least one arm carries a sensor pad, and wherein link means are provided to allow each sensor pad to maintain a desired orientation relative to the mandrel.

10. The apparatus according to claim 9 wherein pivot means are provided to allow each sensor pad to pivot relative to the arm and link means.

11. The apparatus according to claim 1 wherein the resilient biasing means is located between the at least one arm and the drive means.

12. An apparatus for actuating arms comprising:

a mandrel;

at least one arm carried by the mandrel, the at least one arm being mounted to the mandrel to move between an expanded position, in which a part of the arm projects from the mandrel, and a retracted position;

resilient biassing means associated with the at least one arm for biassing the arm towards its expanded position with a resilient biassing force;

a holder associated with the at least one arm for restraining the arm against movement towards its expanded position, the holder being independent of the mandrel; and a driver acting upon the resilient biassing means for adjusting the resilient biassing force acting upon each arm, the driver being separate from the holder.

13. A method of actuating the arms of a data logging tool, wherein the data logging tool includes:

a mandrel;

at least one arm carried by the mandrel, and mounted to the mandrel to move between an expanded position, in which a part of the arm projects from the mandrel, and a retracted position;

resilient biassing means associated with the at least one arm for biassing the arm towards its expanded position;

restraining means associated with the at least one arm for restraining the arm against movement towards its expanded position; and drive means acting upon the resilient biassing means for adjusting a resilient biassing force acting upon the at least one arm;

the method comprising the steps of:

restraining the at least one arm in retracted positions;

locating the tool within a borehole having a borehole wall;

loading the previously unloaded resilient biassing means whilst the arms are restrained;

positioning the tool in a desired position within the borehole; and releasing the retraining means to allow the resilient biassing means to urge the arms against the borehole wall.

* * * * *